US009425522B2

(12) United States Patent
Hung et al.

(10) Patent No.: US 9,425,522 B2
(45) Date of Patent: Aug. 23, 2016

(54) CIRCUIT BOARD CONNECTOR

(71) Applicant: LUXUL TECHNOLOGY INCORPORATION, New Taipei (TW)

(72) Inventors: Yung-Ta Hung, New Taipei (TW); Cheng-Hsien Chen, New Taipei (TW)

(73) Assignee: LUXUL TECHNOLOGY INCORPORATION, New Taipei (TW)

( * ) Notice: Subject to any disclaimer, the term of this patent is extended or adjusted under 35 U.S.C. 154(b) by 55 days.

(21) Appl. No.: 14/337,128

(22) Filed: Jul. 21, 2014

(65) Prior Publication Data

US 2015/0079841 A1 Mar. 19, 2015

(30) Foreign Application Priority Data

Sep. 18, 2013 (TW) ..... 102133861 A

(51) Int. Cl.
*H01R 12/00* (2006.01)
*H01R 12/52* (2011.01)
*H01R 12/57* (2011.01)

(52) U.S. Cl.
CPC ..... *H01R 12/52* (2013.01); *H01R 12/57* (2013.01)

(58) Field of Classification Search
CPC ..... H01R 12/52; H01R 12/57; H01R 9/096; H01R 9/091
USPC ..... 439/65, 83, 876
See application file for complete search history.

(56) References Cited

U.S. PATENT DOCUMENTS 6,468,090 B2 * 10/2002 Belopolsky ..... H01R 13/6463 439/495
6,821,128 B2 * 11/2004 Belopolsky ..... H01R 13/6463 439/495

FOREIGN PATENT DOCUMENTS

JP 01030292 A * 2/1989

* cited by examiner

*Primary Examiner* — Khiem Nguyen
(74) *Attorney, Agent, or Firm* — Pai Patent & Trademark Law Firm; Chao-Chang David Pai

(57) ABSTRACT

The present invention is a circuit board connector, and the circuit board connector comprises an insulative block and at least one electric connecting bar. The insulative block has a supporting surface. The at least one electric connecting bar is mounted through the insulative block, and each electrical connecting bar has two terminals bent to the supporting surface. Each of the terminals has a bending part and a welding part, and the welding part is close to the supporting surface. When two circuit boards are connected, the welding parts of the terminals of the electric connecting bar are welded with bond pads of each of the circuit boards to electronically connect the circuit boards, and the insulative block is connected to the circuit boards to fix the circuit boards. Therefore, the circuit boards can be fixed and electronically connected for forming a large circuit board.

15 Claims, 6 Drawing Sheets

CIRCUIT BOARD CONNECTOR

BACKGROUND OF THE INVENTION

1. Field of the Invention

The present invention relates to a connector, particularly to a circuit board connector that electronically connects two circuit boards and securely fixes ends of the circuit boards together.

2. Description of the Related Art

In electronic industries, each electronic device has a circuit board mounted inside. Length of the circuit board is limited by production technique of the circuit board. When a user needs a circuit board having a length exceeding a length limitation of the production technique of the circuit board, the user connects two circuit boards together to produce the circuit board having the length exceeding the length limitation.

With reference to FIG. 6, a circuit board 40 has multiple bond pads 41 and multiple electronic components 42. The bond pads 41 are mounted on a top surface of the circuit board 40. A method for connecting two circuit boards 40 is welding two ends of an electric wire 50 respectively on two bond pads 41 of two different circuit boards 40. Therefore, the circuit boards 40 are electronically connected by the electric wire 50.

The electric wire 50 electronically connecting the circuit boards 40 needs to be cut, striped, and welded manually. Manually cutting, stripping, and welding the electric wire 50 are complicated and quality control of the electric wire 50 is difficult. Further, the electric wire 50 cannot support the circuit boards 40. The circuit boards 40 need to be mounted securely together by an adhesive or another method to prevent the circuit boards 40 from being separated.

SUMMARY OF THE INVENTION

An objective of the present invention is to provide a circuit board connector that electronically connects two circuit boards and securely fixes ends of the circuit boards together.

To achieve the foregoing objective, the circuit board connector comprises an insulative block and at least one electric connecting bar. The insulative block has a supporting surface. The at least one electric connecting bar is mounted through the insulative block and each electric connecting bar has two terminals bent to the supporting surface. Each of the terminals of the electric connecting bar has a bending part and a welding part, and the welding parts of the terminals are parallel to the supporting surface.

When the circuit boards are electronically connected and fixed by the circuit board connector, one of the terminals of the electric connecting bar is connected to the bond pad of one of the circuit boards and the other one of the terminals of the electric connecting bar is connected to the bond pad of the other one of the circuit boards. The terminals are separately welded on the bond pads of the circuit boards. Therefore, the circuit boards can be electronically connected together by the electric connecting bar of the circuit board connector and be fixed by the insulative block of the circuit board connector. The circuit board connector is welded on the bond pads of the circuit boards easier than manually welding an electric wire on the bond pads of the circuit boards. Further, since the electric connecting bar is mounted through the insulative block and only the terminals of the electric connecting bar are exposed out of the insulative block to electronically connect the circuit boards, the circuit board connector has good insulation characteristics for avoiding unexpected electronical connections between the circuit boards.

Other objectives, advantages and novel features of the invention will become more apparent from the following detailed description when taken in conjunction with the accompanying drawings.

DETAILED DESCRIPTION OF THE INVENTION

Figure 1:
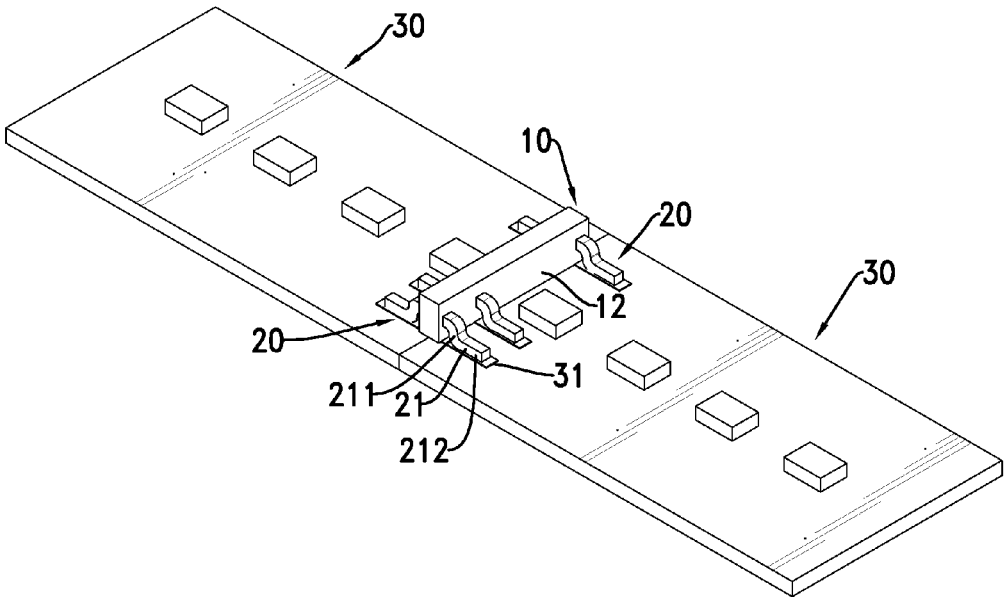
FIG. 1 is a perspective schematic view of a first embodiment of the present invention.
Figure 2:
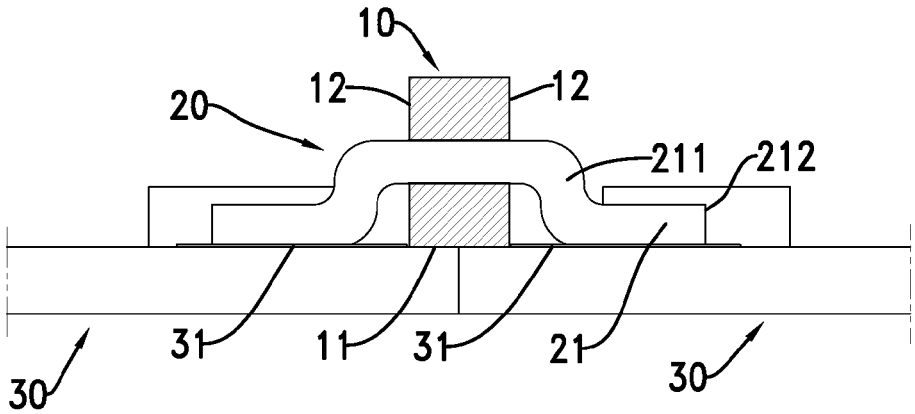
FIG. 2 is a sectional schematic view of the first embodiment of the present invention.

With reference to FIGS. 1 and 2, a first embodiment of a circuit board connector in accordance with the present invention may connect two circuit boards 30 together and comprises an insulative block 10 and at least one electric connecting bar 20.

The insulative block 10 is electrically insulative, is a rectangular parallelepiped, and has a supporting surface 11 and two vertical surfaces 12. The vertical surfaces 12 are parallel to each other, are perpendicular to the supporting surface 11, and connect to the supporting surface 11.

The at least one electric connecting bar 20 may be multiple in quantity. The multiple electric connecting bars 20 are parallel to one another at intervals and are mounted through the vertical surfaces 12 of the insulative block 10. Each electric connecting bar 20 has two terminals 21. The terminals 21 are L-shaped and are formed respectively on two opposite ends of the electric connecting bar 20. Each of the terminals 21 has a bending part 211 and a welding part 212. The bending parts 211 of the terminals 21 of the electric connecting bars 20 are located respectively close to the vertical surfaces 12. The welding part 212 is formed on and protrudes perpendicularly from the bending part 211, and is located close to the supporting surface 11. Preferably, the welding part 212 is flush with the supporting surface 11.

Figure 3:
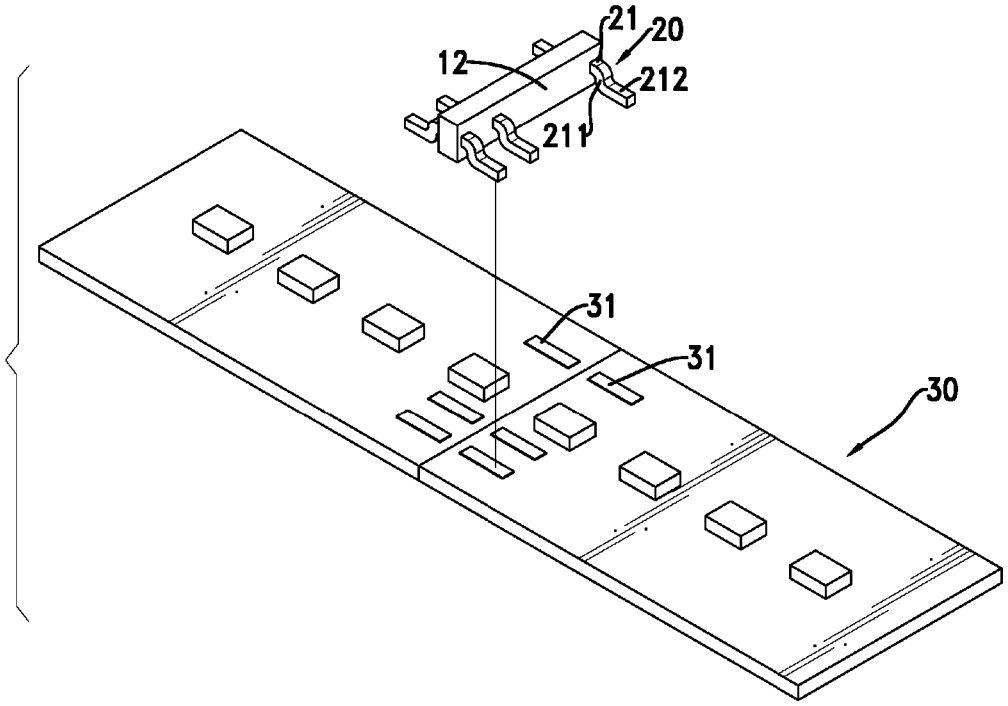
FIG. 3 is a schematic view for using the first embodiment of the present invention.

With further reference to FIG. 3, two adjacent ends of the circuit boards 30 are connected by the circuit board connector. Each circuit board 30 has multiple bond pads 31. The bond pads 31 are mounted on a top surface of the circuit board 30 close to the adjacent ends of the circuit boards. Preferably, three bond pads 31 are mounted on each circuit board 30, and the circuit board connector has three electric connecting bars 20 corresponding to the bond pads 31.

When the circuit boards 30 need to be electronically connected to each other, the bond pads 31 of the circuit boards 30 are aligned. The welding parts 212 of the electric connecting bars 20 are respectively aimed at the bond pads 31 of the circuit boards 30. The two welding parts 212 of each of the electric connecting bars 20 are respectively aimed at two of the bond pads 31 of the circuit boards 30 that are aligned. The supporting surface 11 of the insulative block 10 faces the adjacent ends of the circuit boards 30.

Therefore, the welding parts 212 of the electric connecting bars 20 can be welded on the bond pads 31 of the circuit boards 30. The circuit boards 30 can be fixed and electronically connected together to form a larger circuit board that a user needs.

Figure 4:
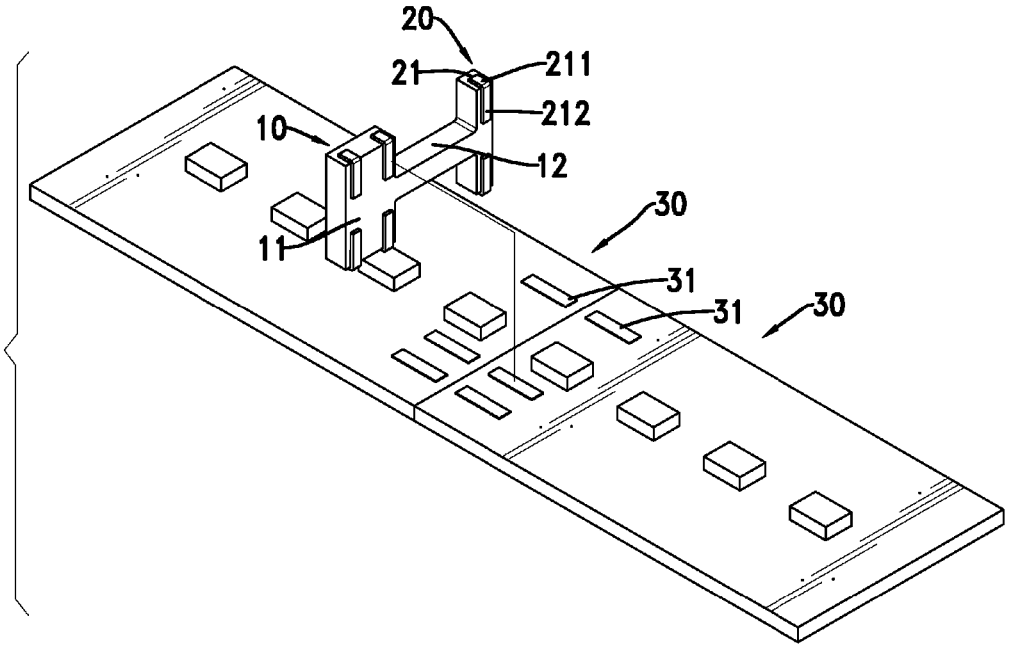
FIG. 4 is a schematic view for using a second embodiment of the present invention.
Figure 5:
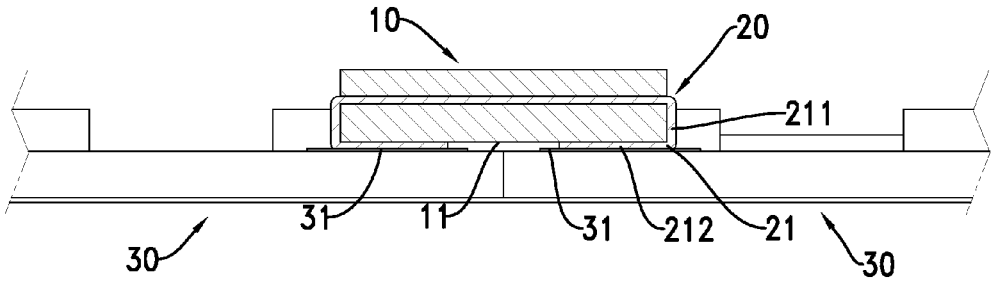
FIG. 5 is a sectional schematic view of the second embodiment of the present invention.
Figure 6:
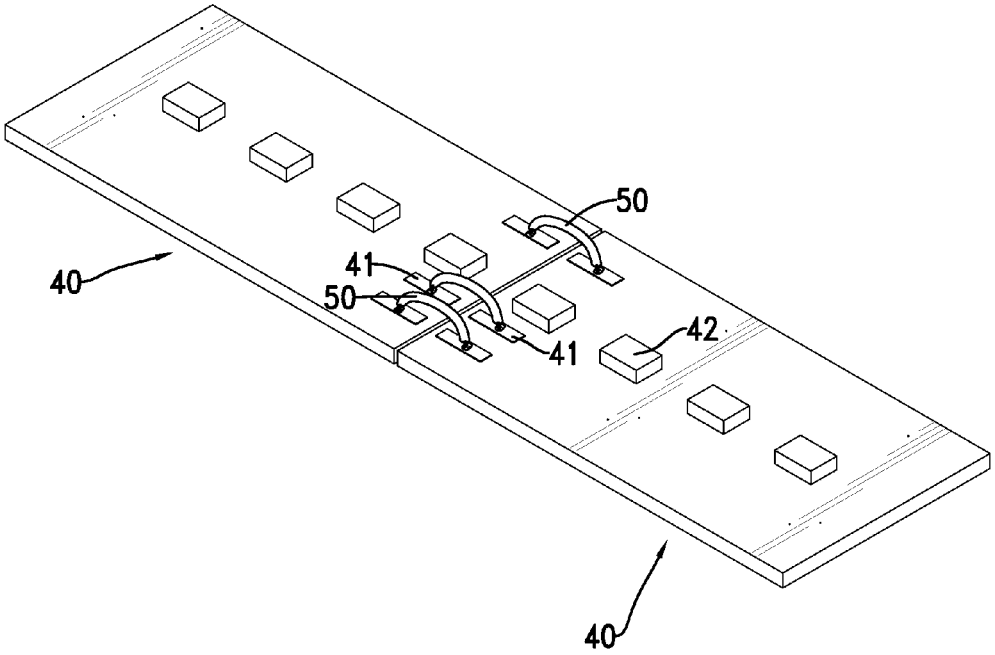
PRIOR ART FIG. 6
FIG. 6 is a schematic view for connecting two circuit boards in accordance of the prior art.

With further reference to FIGS. 4 and 5, a second embodiment of the circuit board connector in accordance with the present invention differs from the first embodiment in that the bending parts 211 of the terminals 21 of the second embodiment are mounted on the vertical surfaces 12 and the welding parts 212 of the terminals 21 are mounted on the supporting surface 11.

When the circuit boards 30 need to be electronically connected to each other, the circuit board connector is mounted by a same way of the first embodiment. The welding parts 212 of the electric connecting bars 20 are separately targeted at the bond pads 31 of the circuit boards 30. The two welding parts 212 of each of the electric connecting bars 20 are respectively aimed at two of the bond pads 31 of the circuit boards 30 that are aligned. The supporting surface 11 of the insulative block 10 faces the adjacent ends of the circuit boards 30.

Since the welding parts 212 are sandwiched between the supporting surface 11 of the insulative block 10 and the bond pads 31 of the circuit boards 30, the welding parts 212 cannot be inadvertently connected to other electronic components mounted on the circuit boards 30. Therefore, short circuits of the electronic components of the circuit boards 30 can be avoided.

The user can easily make larger circuit boards as needed according to the first and the second embodiments of the present invention. The larger circuit boards do not need to be welded with electric wires for electronically connection with the circuit boards 30. The circuit board connector can fix and electronically connect the circuit boards 30. Furthermore, most parts of the electric connecting bars 20 are mounted and hidden in the insulative block 10, and only the terminals 21 of the electric connecting bars 20 are revealed out of the insulative block 10 to electronically connect to the bond pads 31 of the circuit boards 30 for avoiding short circuits of the electronic components of the circuit boards 30.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A circuit board connector, comprising:

an insulative block having a supporting surface capable of supporting adjacent ends of two adjacent circuit boards; and at least one electric connecting bar mounted through the insulative block, each electric connection bar having two terminals formed respectively on two opposite ends of the electric connecting bar;

wherein each of the terminals of the at least one electric connecting bar has a bending part and a welding part, and the welding parts of the terminals are respectively formed on the bending parts and are located close to the supporting surface;

wherein the welding parts of the terminals are respectively connected to the adjacent ends of the two adjacent circuit boards.

2. The circuit board connector as claimed in claim 1, wherein the insulative block is a rectangular parallelepiped, and has two lateral surfaces parallel to each other;

the two lateral surfaces are perpendicular to the supporting surface, and are connected to the supporting surface;

the at least one electric connecting bar is mounted through the two lateral surfaces, and the bending parts of the terminals of the at least one electric connecting bar are located respectively close to the lateral surfaces.

3. The circuit board connector as claimed in claim 2, wherein each of the bending parts of the terminals of the at least one electric connecting bar is respectively mounted on the lateral surfaces.

4. The circuit board connector as claimed in claim 1, wherein the welding parts of the terminals of the at least one electric connecting bar are flush with the supporting surface.

5. The circuit board connector as claimed in claim 1, wherein the welding parts of the terminals of the at least one electric connecting bar are respectively mounted on the supporting surface.

6. The circuit board connector as claimed in claim 1, wherein the terminals are L-shaped; and the welding parts of the terminals protrude perpendicularly from the bending parts, respectively.

7. The circuit board connector as claimed in claim 2, wherein the welding parts of the terminals of the at least one electric connecting bar are flush with the supporting surface.

8. The circuit board connector as claimed in claim 3, wherein the welding parts of the terminals of the at least one electric connecting bar are flush with the supporting surface.

9. The circuit board connector as claimed in claim 2, wherein the welding parts of the terminals of the at least one electric connecting bar are respectively mounted on the supporting surface.

10. The circuit board connector as claimed in claim 3, wherein the welding parts of the terminals of the at least one electric connecting bar are respectively mounted on the supporting surface.

11. The circuit board connector as claimed in claim 4, wherein the welding parts of the terminals of the at least one electric connecting bar are respectively mounted on the supporting surface.

12. The circuit board connector as claimed in claim 2, wherein the terminals are L-shaped; and the welding parts of the terminals protrude perpendicularly from the bending parts, respectively.

13. The circuit board connector as claimed in claim 3, wherein the terminals are L-shaped; and the welding parts of the terminals protrude perpendicularly from the bending parts, respectively.

14. The circuit board connector as claimed in claim 4, wherein the terminals are L-shaped; and the welding parts of the terminals protrude perpendicularly from the bending parts, respectively.

15. The circuit board connector as claimed in claim 5, wherein the terminals are L-shaped; and the welding parts of the terminals protrude perpendicularly from the bending parts, respectively.

* * * * *